US007889881B2

(12) United States Patent
Ostrowski

(10) Patent No.: US 7,889,881 B2
(45) Date of Patent: Feb. 15, 2011

(54) EAR CANAL SPEAKER SYSTEM METHOD AND APPARATUS

(76) Inventor: Chris Ostrowski, 3528 Seneca Dr., Mount Vernon, WA (US) 98273-5700

( * ) Notice: Subject to any disclaimer, the term of this patent is extended or adjusted under 35 U.S.C. 154(b) by 1256 days.

(21) Appl. No.: 11/380,087

(22) Filed: Apr. 25, 2006

(65) Prior Publication Data

US 2007/0253587 A1 Nov. 1, 2007

(51) Int. Cl.
*H04R 25/00* (2006.01)

(52) U.S. Cl. ..... 381/329; 381/328; 381/379; 381/380

(58) Field of Classification Search ..... 381/328–329, 381/379–380; 181/130
See application file for complete search history.

(56) References Cited

U.S. PATENT DOCUMENTS

| | | | | |
|---|---|---|---|---|
| 2,487,038 | A | 11/1949 | Baum | |
| 2,545,731 | A | 3/1951 | French | |
| 3,301,253 | A | 1/1967 | Glorig | |
| 3,415,246 | A | 12/1968 | Hill | |
| 4,006,796 | A * | 2/1977 | Coehorst | 181/130 |
| 4,133,984 | A * | 1/1979 | Akiyama | 381/328 |
| 4,150,262 | A | 4/1979 | Ono | |
| 4,539,440 | A * | 9/1985 | Sciarra | 381/329 |
| 4,864,610 | A | 9/1989 | Stevens | |
| 5,396,563 | A | 3/1995 | Yoshimi | |
| 5,757,932 | A * | 5/1998 | Lindemann et al. | 381/312 |
| 5,949,896 | A | 9/1999 | Nageno et al. | |
| 6,129,175 | A | 10/2000 | Tutor et al. | |
| 6,256,396 | B1 * | 7/2001 | Cushman | 381/328 |
| 6,801,629 | B2 | 10/2004 | Brimhall et al. | |
| 6,922,476 | B2 | 7/2005 | Nassimi | |
| 7,362,875 | B2 * | 4/2008 | Saxton et al. | 381/322 |
| 2005/0123163 | A1 | 6/2005 | Oliveira et al. | |
| 2005/0141743 | A1 | 6/2005 | Seto | |
| 2005/0147269 | A1 | 7/2005 | Oliveira et al. | |
| 2007/0183613 | A1 * | 8/2007 | Juneau et al. | 381/322 |

* cited by examiner

*Primary Examiner*—Curtis Kuntz
*Assistant Examiner*—Ryan Robinson
(74) *Attorney, Agent, or Firm*—Dwayne E. Rogge; Hughes Law Firm, PLLC

(57) ABSTRACT

An earpiece adapted to transmit acoustic sound into an year, the earpiece having a flexible ear canal engagement member that is adapted to be repositioned longitudinally inwardly by way of some form of an extension member. When the extension member is released, the member contracts to a first position, thereby increasing a portion of its cross-sectional diameter at some portion thereof to engage the ear canal of a user's ear to securely fit the device to the user's ear.

13 Claims, 6 Drawing Sheets

EAR CANAL SPEAKER SYSTEM METHOD AND APPARATUS

BACKGROUND OF THE INVENTION a) Field of the Invention

This invention relates to an in-the-ear type acoustic device of which a part is adapted to conform to the inner wall of the external acoustic meatus of a person's ear and thus improve comfort, noise quality, and stability within the ear. The invention is applicable to all types of audio devices which use external speakers.

b) Background Art

Earphones and headphones are well known in the prior art as a convenient way of transmitting sound. An earphone generally is a device, which can be removably attached to a user's outer ear and is light and somewhat comfortable. Many earphones include a soft foam portion, which covers part of the device to aid in comfort and stability. Due to the fact that no two peoples' ears are the same, some devices so fitted are now marketed with a plurality of shapes and/or sizes of these foam portions to fit a variety of ear shapes and sizes. Other designs include a portion that is generally shaped to fit partially into the concha of a person's ear and rest against the tragus and/or anti-tragus to maintain stability. Each earphone side portion generally includes a speaker device to provide desired sound to a person's inner ear while blocking unwanted noise through their bulk and design.

Headphones are designed along very similar lines but generally include a band that goes over the head to keep the pair of headphones on a user's head and maintain stability.

SUMMARY OF THE DISCLOSURE

The current disclosure provides an improved design for an in the ear type earphone. By providing a system for the outer surface of the earphone to adapt to the inner surface of a user's external auditory meatus, an earphone can be produced that increases comfort while increasing stability without added discomfort nor the time and expense of a fitted earpiece. Present analysis indicates that the earphone as described herein will remain in the ear and move relatively little in relation to the user's ear even while the user is involved in activities such as running, skiing, jogging, swimming and similar sports or exercises such as riding a stationary bicycle, treadmill, or similar exercises. These advantages are provided by a device having a flexible outer member housing a sound producing device and a means to change the shape of the outer member like member to ease in insertion into a user's ear and also to conform to the inner diameter of a user's exterior auditory meatus.

DESCRIPTION OF THE PREFERRED EMBODIMENTS

Figure 1:
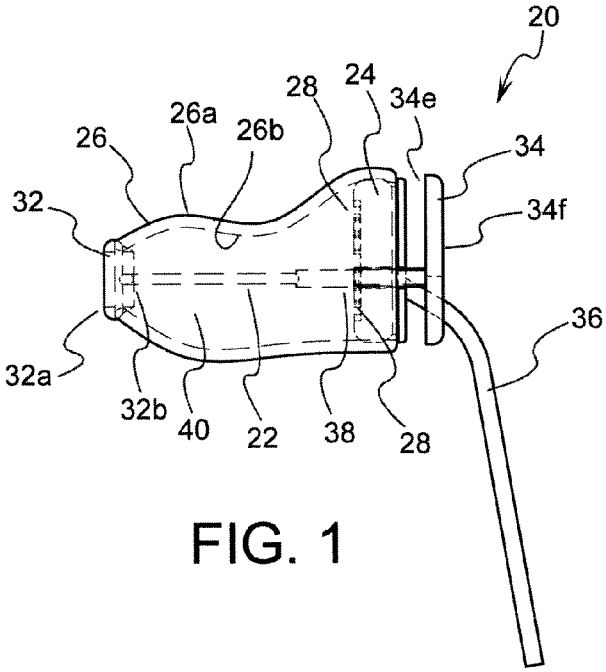
FIG. 1 is an illustration of an embodiment of the ear piece in the relaxed state or first position.

For the sake of consistency, the same reference numeral will be used to denote the same element in all the figures and in the description. Furthermore, in order to avoid needlessly cluttering the drawings, certain elements have been purposely omitted. Some of these elements not shown are mentioned in the description or completely omitted if they are only of a very secondary nature with respect to the invention. For example the axis system shown in FIG. 11 relates to all the figures and embodiments.

Figure 11:
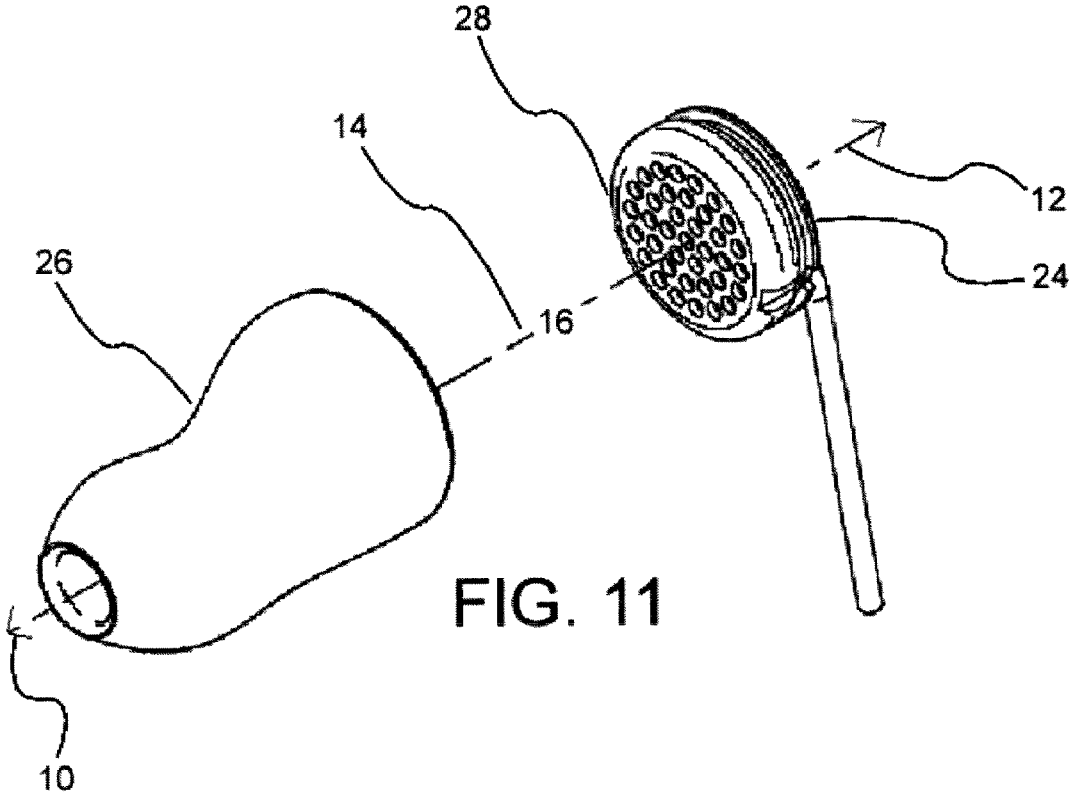
FIG. 11 is an orthogonal view of a simplified embodiment of the invention.

For ease of description an axis system is shown in FIG. 11. The longitudinal axis 16 extends substantially along the center portion of the device. When the ear insertable earphone device is use, the longitudinally inward direction 10 is generally the direction in which the invention is inserted into the user's ear. Similarly, the longitudinally outward direction 12 points away from the user's ear, and the radially outward direction 14 points substantially away from the center of the invention, perpendicular to the longitudinal axis.

The insertable earphone device 20 as shown in FIG. 1 in general comprises an extension member 22, a base member 24, a flexible ear canal engagement member 26, and a speaker member 28. The device 20 further has a user interface portion 34 having a longitudinally outward surface 34*f* and a longitudinally inward surface 34*e* movably attached to the base member 24. The base member 24 has a longitudinally inward surface 24*b* and a longitudinally outward surface 24*a*(see FIG. 3). The longitudinally inward surface 24*b* of the base member 24 is movably attached to an extension 22 in one form. This extension 22 may be formed as part of the interface portion 34 or may be a separate element attached to the interface portion 34 in any manner known in the art.

Figure 4:
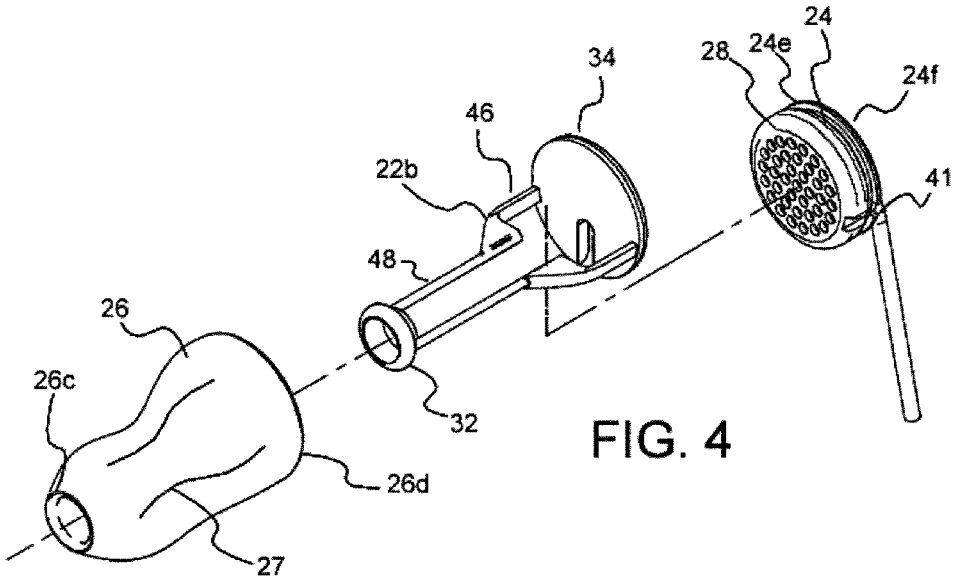
FIG. 4 is an exploded view of an embodiment of the ear piece where the extension member is generally a pair of rods.
Figure 9:
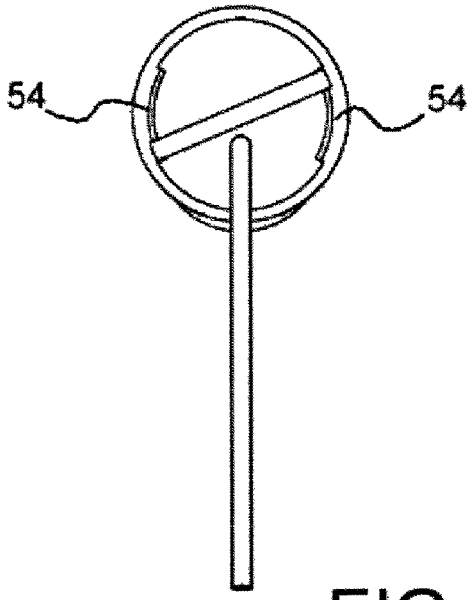
FIG. 9 is a view of the invention revealing the mechanism for operating the invention where the extension member 22*c* is generally a cylinder.
Figure 10:
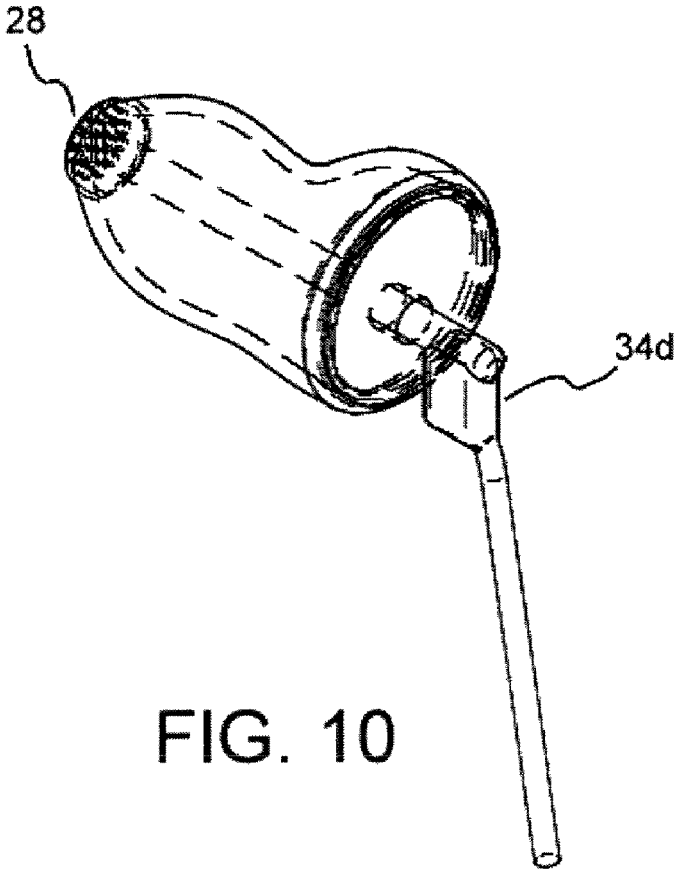
FIG. 10 is an orthogonal view of the invention where the speaker member 28 is attached to the longitudinally inward portion of the extension member 20. Also shown is another possible configuration for the interface portion 34*d*.
Figure 12:
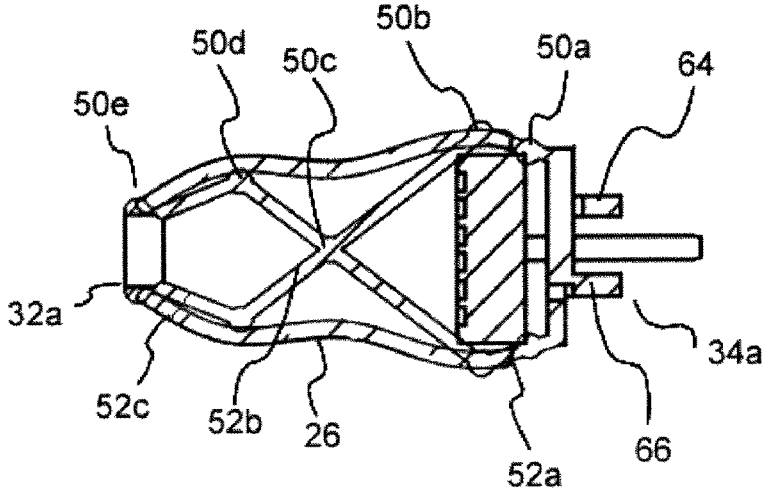
FIG. 12 is a cross sectional view of invention where the extension member 22*a* is generally a series of levers operated in a scissor like manner.

The extension 22 may be made of a rigid material such as plastic or the like. The extension member 22 has a longitudinally inward portion 32 and a longitudinally outward portion 38 movably attached to the base member 24. Several methods for attaching the extension member 22 to the base member 24 are shown such as: a hole in the base member parallel to the axis 16 of the device as shown in FIG. 10, notches 41 in the radially outer edge of the base member 24 as shown in FIG. 4, pivot points 50 as shown in FIG. 12, grooves 54 as illustrated in FIG. 9, or similar methods. These various embodiments are described in more detail herein. It can be appreciated that various other attachment methods can be employed without departing from the spirit and scope of the invention as recited in the claims below.

The longitudinally inward portion 32 may be generally a torus in shape. This torus having a major diameter parallel to the axis 16 of the device and having a surface defining a central opening and generally aligned with the axis 16. This longitudinally inward portion 32 of the extension member 22 is attached to or formed as part of the extension member 22 and is adapted to move therewith.

Figure 2:
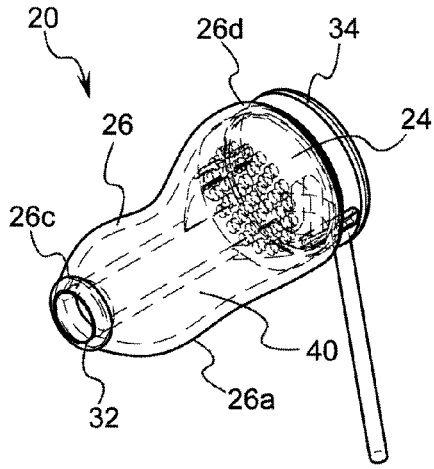
FIG. 2 is an orthogonal view of an embodiment of the ear piece in the relaxed state or first position.

As shown in FIG. 2, a flexible ear canal engagement member 26 has an outer surface 26*a* adapted to engage the user's ear canal and is attached to the longitudinally inward portion 32 of the extension member 22. The flexible ear canal engagement member 26 has a longitudinally inward portion 26*c* that is attached to the longitudinally inward portion 32 of the extension member 22 and a radially outward portion 26*d* that is attached to the base member 24. The flexible ear canal engagement member 26 has an inner surface 26*b* which in conjunction with the inner surface of the base member 24*b* and the inner surface of the longitudinally inward portion 32*b* of the extension member 22 forms a chamber 40.

When the extension member 22 is positioned in a first position, as shown in FIG. 2, the flexible member 26 has a cross-sectional diameter which engages the user's exterior auditory meatus. The longitudinally inward portion of the extension member 32 is adapted to be repositioned with respect to the base member 24 to a second position to reduce the cross-sectional size of the flexible ear canal engagement member 26 which makes it easier to insert the invention into the user's auditory meatus and may make it easier to remove. Several different embodiments are shown herein to achieve this repositioning of the member 26.

Figure 3:
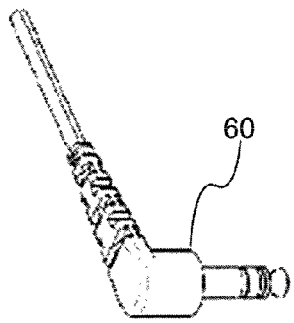
FIG. 3 is an illustration of an embodiment of the ear piece in the extended or second position.
Figure 3:
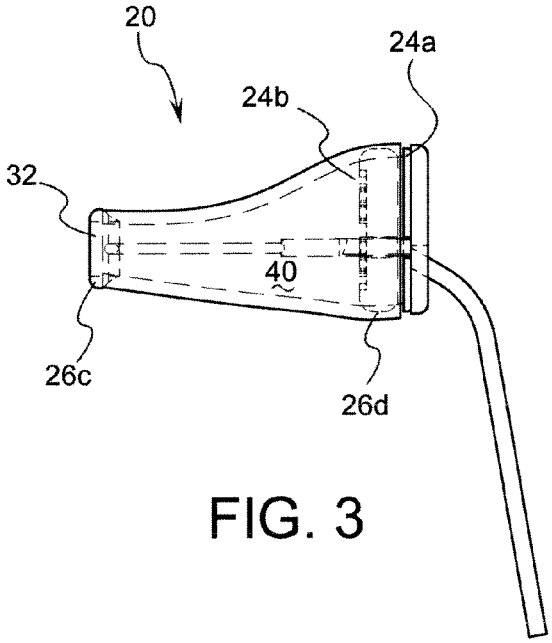
Figure 5:
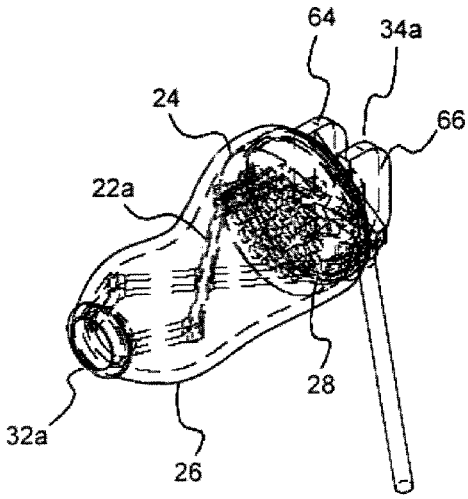
FIG. 5 is an orthogonal view of an embodiment of the ear piece where the extension member is generally a series of levers operated in a scissor like manner
Figure 7:
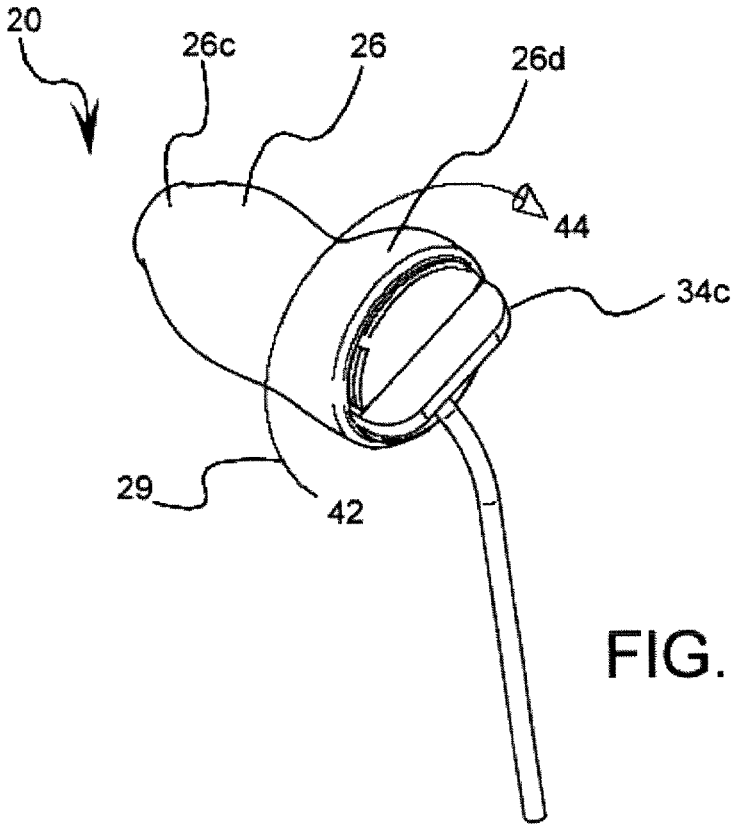
FIG. 7 is an orthogonal view of the invention where the extension member 22*c* is generally a cylinder.

In one embodiment, the extension member 22 is adapted to extend from the first position, as shown in FIG. 1, to the second position, as shown in FIG. 3. As shown in FIGS. 1, 2 3, and 10, the repositioning of the member 26 can be accomplished by exerting force on the interface portion in the longitudinally inward direction. Extending the extension member 22 may also be accomplished by engaging a series of lever arms 22*a* as shown in FIG. 5, or by rotating the interface portion 34*c* as shown in FIG. 7. Each of these variations are described below.

Now referring to FIG. 4, there is shown an embodiment where the extension member 22*b* is generally a pair of rods 22*b* with the longitudinal axis of the rods substantially parallel to the longitudinal axis of the ear insertable acoustic device 16. This embodiment operates by exerting force on the interface portion 34. This force is transmitted around the base portion 24 via notches in the side of the base portion 24. The extension member 22*b* has a longitudinally outward portion 46 which is movably attached to the base member 24 via these notches. The extension member 22*b* also has a longitudinally inward portion 48 which connects the longitudinally outward portion 46. The flexible ear canal engagement member 26 is attached at its longitudinally inward portion 26*c* to the longitudinally inward portion of the extension member 32. The member 26 is further attached at a longitudinally outward portion 26*d* to the base member 24. The base member 24 has a longitudinally inward surface 24*e* and longitudinally outward surface 24*f*, the longitudinally inward surface is formed to conform to the approximate shape of the speaker member 28.

Figure 8:
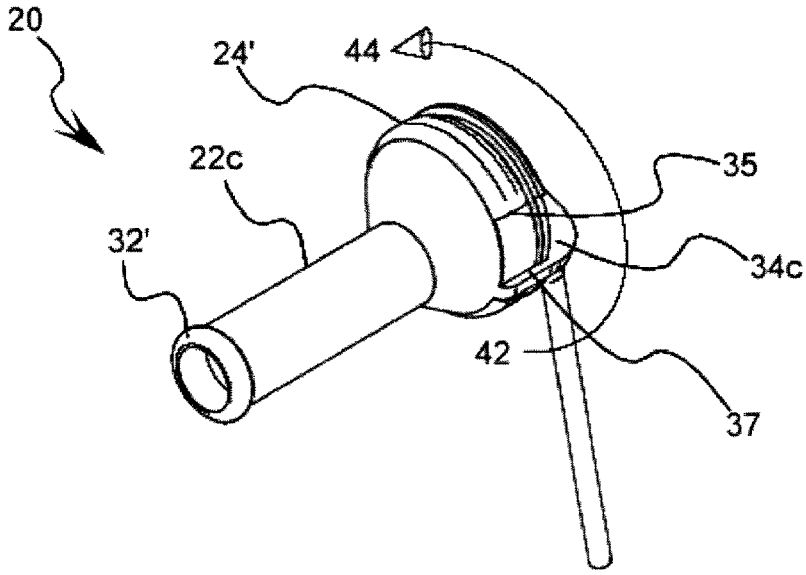
FIG. 8 is an orthogonal view of the invention revealing the mechanism for operating the invention where the extension member 22*c* is generally a cylinder with the flexible outer member 26 removed.

In FIGS. 7 and 8 an embodiment is illustrated where the extension member 22*c* is generally cylindrical with the longitudinal axis of the cylinder 22*c* parallel to and generally concentric with the longitudinal axis of the ear acoustic device 16. In this embodiment, the extension member 22*c* is adapted to rotate around a longitudinal axis 16 from a first position 42 to a second position 44. As in other embodiments, the flexible outer member 26 has a cross sectional area in the first position which is larger than the cross sectional area in the second position. This allows for easy insertion into and removal from the user's external auditory meatus. As shown in FIG. 8, the radially outward portion 26D of the member 26 is attached to the base portion 24'. The longitudinally inward portion 26C as shown in FIG. 7 is attached to the longitudinally inward portion of the extension member 32', as shown in FIG. 8. Therefore, it can be appreciated that instead of a laterally inward repositioning of the extension member 22C, the rotation as illustrated by the arrow 29 in FIG. 7 reduces the cross-sectional area of the outer surface 26A of the member 26.

Further, as shown in FIG. 8, the handle-like interface portion 34C can have a range limiting-type arrangement where the portion of the base surface 35 engages the extension 37 to limit the amount of rotation and torque exerted upon the number 26.

Figure 6:
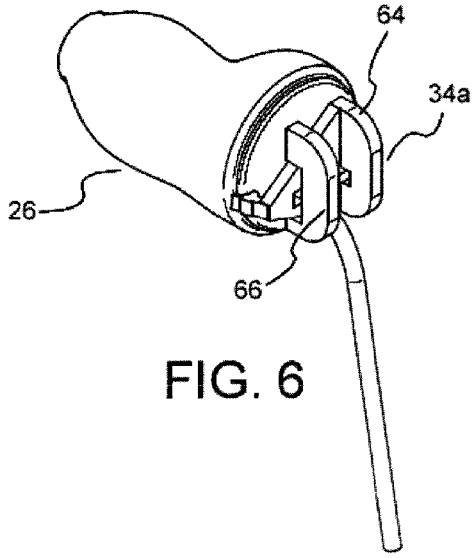
FIG. 6 is an orthogonal view of the invention revealing the mechanism for interfacing with the invention 34*a* where the extension member 22*c* is generally a series of levers operated in a scissor like manner.

FIGS. 5, 6, and 12 show an embodiment where the extension member 22 is generally a series of opposing lever arms 22*a*. Such series of lever arms are very common in the mechanical arts. This assembly of lever arms is movably coupled to the base member 24 and is coupled to a longitudinally inward portion of the extension member 32*a*. This assembly is configured such that when the interface portion 34*a* is engaged, the extensions 64 and 66 are pinched together and the arms extend the longitudinally inward portion of the extension member 32*a* away from the base member 24. This reduces the cross sectional area of the flexible member 26 and aids in the insertion and removal of the invention into the external auditory meatus of a user's ear. This embodiment essentially operates by pinching the interface portion 34*a* which pivots the lever arms at points 50*a*-50*e*, thus moving the longitudinally inward portion of the extension member 32 in a longitudinally inward direction in relation to the base member 24. This motion "stretches" the flexible ear canal engagement member 26 and reduced the radial diameter of the member 26, making it easier to insert into the user's ear. It should be further noted by way of example as illustrated in FIG. 5, that instead of pinching the extension 64 and 60, other such mechanisms could be utilized. For example, the interface portion 34A could have a member which is actually pulled in the longitudinally outward direction whereby this action would extend the scissorlike lever arms. FIG. 11 shows an embodiment where the member is not positively repositioned longitudinally inwardly by way of any actuating mechanism. This embodiment is adapted so that when the embodiment is inserted in the ear, the flexible member conforms to the inner surface of the external acoustic meatus of a user's ear. In this embodiment, the shape and composition of the flexible ear canal engagement member 26 are such that insertion and stability are achieved without a movable extension member 22.

It may be preferable in any of the embodiments for the thickness of the wall of the flexible ear canal engagement member 26 to vary from one longitudinal end to the other. For example, as shown in the partial cross-sectional view in FIGS.

1 and 3, along the various longitudinal locations around the circumferential regions about the flexible ear canal engagement member 26, the thickness can be adjusted to more properly be deformed in desirable locations, particularly in FIG. 3 wears it is in the extended second position. Therefore, when the member 26 contracts to the relaxed location, it will engage the external acoustic meatus of the user's ear in a more desirable manner.

Figure 13:
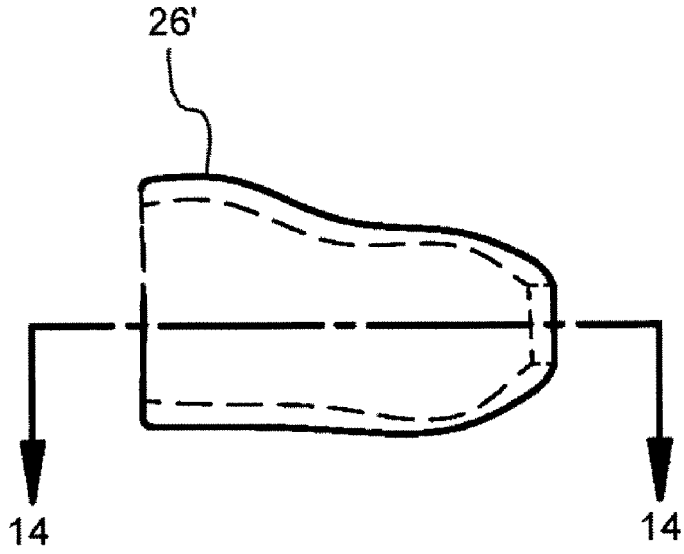
FIG. 13 shows an alternative of view of a flexible ear canal engagement member.
Figure 14:
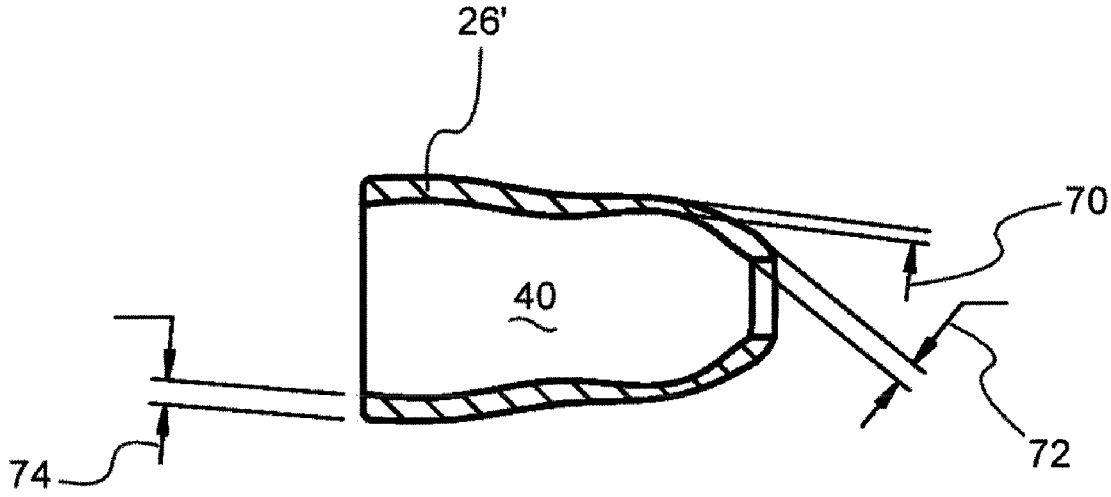
FIG. 14 is taken at line 14-14 of FIG. 13 showing an example of varying the thickness along the longitudinal direction of the flexible ear canal engagement member.

For example, as shown in FIG. 13, there is another side profile of one form of a flexible ear canal engagement member 26'. FIG. 14 shows a top cross-sectional view of the unit, where, for example, the dimension indicated at 70 can be approximately 0.028 inches. Further, the dimension indicated at 72 in one form can be about 0.05 inches. Referring to the left-hand portion of FIG. 14, the dimension indicated at 74 in one form can be about 0.053 inches. Of course, this is one desirable thickness of a flexible material to comprise the member 26'. In a preferred range, these variations can fluctuate approximately 10-15% in thickness, and in a broader range, plus or minus 25% or more. Of course various modifications and variations can be utilized to accommodate a wide variety of internal portions of the user's ear. Further, certain variations and cross-sectional patterns can be utilized to provide a more robust design that is adapted to comfortably fit in a plurality of different ear types. Further, in one form, the assembly 20 can be delivered to a consumer with a variety of differently sized members 26 that are attached to the extension member and the base member in a manner so as to be easily replaced by the user. This can allow for a custom fit to the user's likings to select the best preferred fit from a plurality of members 26.

Now referring to FIG. 2, there is shown an embodiment where the speaker member 28 is attached to the base member. In this embodiment the speaker driver portion of the speaker device 28 is adapted to transmit sound to the chamber 40. The interior chamber 40 is open via a hole through the longitudinally inward portion 32 of the extension member 22. Through this hole the sound waves generated by the speaker portion 28 are carried into the user's inner ear.

FIG. 10 shows an embodiment where the speaker member 28 is attached to the longitudinally inward portion of the extension member 32. In this embodiment the speaker driver portion of the speaker device 28 is adapted to transmit sound directly into the users exterior auditory meatus and thus to the user's inner ear.

In any of the described embodiments it may be preferable to provide n audio connection to an electronic sound signal device such as a cell phone, iPod™, stereo, or similar device. Such a means may be accomplished by attaching the wire 36 at a first end to the speaker member, and at a second end to a plug which can be removably attached to an electronic device. Said means may also be accomplished by wireless technology having a receiver coupled to the described embodiment. Additionally, other technologies such as Bluetooth can be utilized to transmit sound from the base region 24 to a corresponding Bluetooth transmitting device.

Another embodiment is demonstrated in the use of an assembly consisting of a pair of the ear insertable devices are combined such that the speaker member 28 is attached to a second speaker member of a second ear insertable device via a wire 36 which is adapted to convey electrical signals to both of the speaker members 28. This assembly may be configured to receive a single signal for mono sound or with a plurality of signals to provide stereo sound to the user. This manner of combining speaker elements in pairs is well known in the art.

In any of the described embodiments it may be preferable to shape the flexible outer member to improve performance. One method as mentioned above involves providing a flexible member where the thickness of the wall of the flexible ear canal engagement member varies from one longitudinal end to the other. Another way this improvement may be accomplished is by providing a flexible member where the outer surface of the wall of the flexible ear canal engagement member further includes an area forming ridges 27 as shown in FIG. 4. The shape and position of these ridges may be adapted to best advantage for each embodiment. Yet another way this improvement may be accomplished is by providing a flexible member where the flexible ear canal engagement member is composed of a material containing silicone.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

Therefore I claim:

1. An ear insertable earphone device having a longitudinal axis adapted to be inserted into the ear canal of an individual, the device comprising, a) a base member, the base member having an inner and an outer surface, b) an extension member movably attached to the base member, the extension member having a longitudinally inward portion, and adapted to be repositioned along the longitudinal axis relative to the base member, c) wherein the extension member repositions as a rigid unitary structure, d) a flexible ear canal engagement member having an outer surface adapted to engage the ear canal, the flexible ear canal engagement member having a longitudinally inward portion that is attached to the longitudinally inward portion of the extension member and a longitudinally outward portion that is attached to the base member, e) a speaker member to transmit sound to the interior ear canal, f) whereby when the extension member which is adapted to be positioned in a first position, the longitudinally inward portion of the extension member is adapted to be repositioned with respect to the base member to a second position to reduce the cross-sectional size of the flexible ear canal engagement member, to be positioned in an ear canal.

2. The ear insertable acoustic device as recited in claim 1 where the extension member is adapted to extend from the first position in the longitudinally outward direction to the second position.

3. The ear insertable acoustic device as recited in claim 1 where the speaker member is attached to the base member.

4. The ear insertable acoustic device as recited in claim 3 where the speaker device is adapted to transmit sound to a chamber defined by an inner surface of the flexible ear canal engagement member.

5. The ear insertable acoustic device as recited in claim 4 where the chamber is in communication to a surface defining an opening in the longitudinally inward portion of the extension member.

6. The ear insertable acoustic device as recited in claim 1 where the speaker member is attached to the longitudinally inward portion of the extension member.

7. The ear insertable acoustic device as recited in claim 1 where the speaker member is attached to a second speaker member of a second ear insertable device via a wire which is adapted to convey electrical signals to both of the speaker members.

8. The ear insertable earphone device as recited in claim 1 where the thickness of the wall of the flexible ear canal engagement member varies from one longitudinal end to the other.

9. The ear insertable earphone device as recited in claim 1 where the outer surface of the wall of the flexible ear canal engagement member further comprises an area forming ridges.

10. The ear insertable earphone device as recited in claim 1 where the flexible ear canal engagement member is composed of a material containing silicone.

11. The ear insertable acoustic device as recited in claim 9 where the extension member is adapted to rotate around a longitudinal axis from the first position to the second position.

12. The ear insertable acoustic device as recited in claim 1 where the extension member is generally a pair of rods with the longitudinal axis of the rods substantially parallel to the longitudinal axis of the ear insertable acoustic device.

13. An acoustic apparatus comprising:

a) a base member, the base member having an inner and an outer surface, b) a rigid extension member movably attached to the base member, the extension member having a longitudinally inward portion, and adapted to be linearly repositioned along the longitudinal axis relative to the base member, c) a flexible ear canal engagement member having an outer surface adapted to engage the ear canal, the flexible ear canal engagement member having a longitudinally inward portion that is attached to the longitudinally inward portion of the extension member and a longitudinally outward portion that is attached to the base member, d) a speaker member to transmit sound to the interior ear canal, e) whereby when the extension member which is adapted to be positioned in a first position, the longitudinally inward portion of the extension member is adapted to be repositioned linearly with respect to the base member to a second position to reduce the cross-sectional size of the flexible ear canal engagement member, to be positioned in an ear canal, f) a connection means coupled to the speaker member, and g) an electronic sound signal device configured to provide an acoustic signal to the connection means.

* * * * *